US009431736B2

(12) United States Patent
Chen

(10) Patent No.: US 9,431,736 B2
(45) Date of Patent: Aug. 30, 2016

(54) CARD EDGE CONNECTOR AND CARD EDGE CONNECTOR ASSEMBLY

(71) Applicant: BING XU PRECISION CO., LTD, New Taipei (TW)

(72) Inventor: Chih-jung Chen, New Taipei (TW)

(73) Assignee: BING XU PRECISION CO., LTD., New Taipei (TW)

( * ) Notice: Subject to any disclaimer, the term of this patent is extended or adjusted under 35 U.S.C. 154(b) by 0 days.

(21) Appl. No.: 14/790,621

(22) Filed: Jul. 2, 2015

(65) Prior Publication Data

US 2016/0006152 A1 Jan. 7, 2016

(30) Foreign Application Priority Data

Jul. 3, 2014 (TW) ..... 103211839 U

(51) Int. Cl.

*H01R 12/79* (2011.01)
*H01R 12/72* (2011.01)
*H01R 12/73* (2011.01)
*H01R 12/62* (2011.01)

(52) U.S. Cl.

CPC ..... *H01R 12/79* (2013.01); *H01R 12/732* (2013.01)

(58) Field of Classification Search

CPC ..... H01R 12/79; H01R 12/57; H01R 12/62; H01R 12/721; H01R 12/732; H01R 12/71; H01R 12/72; H01R 12/727; H01R 12/728; H01R 12/77; H01R 12/78

USPC ..... 439/493, 660

See application file for complete search history.

(56) References Cited

U.S. PATENT DOCUMENTS 4,850,899 A * 7/1989 Maynard ..... H01R 31/06 439/628
9,033,744 B2 * 5/2015 Chen ..... H01R 12/721 439/660
9,077,124 B2 * 7/2015 Chen ..... H01R 12/721
2013/0337699 A1 12/2013 Chen
2016/0079709 A1 * 3/2016 Su ..... H01R 13/6477 439/660

FOREIGN PATENT DOCUMENTS

TW M442603 U 12/2012

* cited by examiner

*Primary Examiner* — James Harvey
*Assistant Examiner* — Matthew T Dzierzynski
(74) *Attorney, Agent, or Firm* — Hauptman Ham, LLP

(57) ABSTRACT

A card edge connector includes a first insulator, a second insulator, first terminals, second terminals, and a circuit transferring board. The first insulator has a plug space, first terminal holes, and second terminal holes. The second insulator abuts against the first insulator and has first slotted holes, second slotted holes, and a slot. The first terminals are disposed within the first terminal holes and the first slotted holes, and the second terminals are disposed within the second terminal holes and the second slotted holes. The circuit transferring board is inserted into the slot. The circuit transferring board has first conductive portions and second conductive portions, where back contact portions of the first and second terminals are electrically coupled to the first and second conductive portions, thereby solving a problem of a conventional welded connection. The present invent also provides a card edge connector assembly.

18 Claims, 7 Drawing Sheets

1

CARD EDGE CONNECTOR AND CARD EDGE CONNECTOR ASSEMBLY

TECHNICAL FIELD OF THE INVENTION

The present invention relates to an electrical connector and an electrical connector assembly, and in particular to a card edge connector electrically coupled to a circuit board and a card edge connector assembly.

BACKGROUND OF THE INVENTION

Conventional techniques can refer to Taiwan patent publication No. M442603 which reveals a card edge cable connector assembly. The cable connector includes an insulating housing, a circuit board, a cable, and a cover. The insulating housing includes a plurality of first terminals and second terminals inserted therein, and the first terminals and the second terminals can be electrically connected to the cable via the circuit board. The first terminals are above the second terminals, and contacts of the first terminals, and mating portions of the first terminals and the second terminals stretch into a plug space of the insulating housing. Accordingly, the plug space can be used for an external circuit board to plug in such that the first terminals and the second terminals electrically contact with the external circuit board for achieving electrical interconnection. All ends of the first and second terminals herein must be welded to welding portions on the circuit board through a welding process.

However, the prior art card edge cable connector requires complex welding equipment and processes to weld the terminals and the circuit board together. This not only requires complicated manual work, but is also very difficult to manufacture. Moreover, the terminals need to be desoldered when that requires service. It is not conducive to repair work, and also increases the overall cost of manufacturing. Thus, there is a requirement to improve the structure, in order to meet the demand.

SUMMARY OF THE INVENTION

Accordingly, an objective of the present invention is to provide a card edge connector, which employs two docking insulators for disposing terminals therebetween, and the terminals are designed to have two elastic contact portions respectively at both ends so that front contact portions can electrically contact an external circuit board, and back contact portions can electrically contact a circuit transferring board that is electrically coupled to a flexible flat cable. Therefore, the problem of the high cost of manufacturing by using the conventional welding process can be solved, and the difficulty of the repair work can be reduced.

Another objective of the present invention is to provide a card edge connector assembly, which employs the said card edge connector to solve the problem of the high cost of manufacturing by using the conventional welding process and reduces the difficulty of the repair work.

To achieve the foregoing objectives, the card edge connector provided by an embodiment of the present invention is utilized to couple to a circuit board. The card edge connector includes a first insulator, a second insulator, a plurality of first terminals, a plurality of second terminals, a circuit transferring board, and a flexible flat cable. The first insulator has a plug space for coupling to the circuit board, and the first insulator has a plurality of first terminal holes located above the plug space and a plurality of second terminal holes located below the plug space. The second insulator has a front end face and a back end face, and the front end face abuts against the first insulator and has a plurality of first slotted holes interconnecting with the first terminal holes and a plurality of second slotted holes interconnecting with the second terminal holes. The back end face has a slot. The first terminals are disposed within the first terminal holes and the first slotted holes. The second terminals are disposed within the second terminal holes and the second slotted holes, wherein the first terminals and the second terminals comprise a plurality of front contact portions and a plurality of back contact portions. The front contact portions reach the plug space via the first terminal holes and the second terminal holes, and the back contact portions reach the slot via the first slotted holes and the second slotted holes. The circuit transferring board is inserted into the slot of the second insulator. The circuit transferring board comprises a plurality of first conductive portions, second conductive portions, and welding portions, wherein the back contact portions are electrically coupled to the first conductive portions and the second conductive portions. The flexible flat cable comprises a plurality of conductors which are welded to the welding portions of the circuit transferring board.

In one preferred embodiment, the first conductive portions are disposed on an upper surface of the circuit transferring board, and the second conductive portions are disposed on a lower surface of the circuit transferring board. The back contact portions of the first terminals electrically contact the first conductive portions, and the back contact portions of the second terminals electrically contact the second conductive portions. Furthermore, the welding portions are disposed on a surface of the circuit transferring board, and the first conductive portions and the second conductive portions are electrically coupled to the welding portions. In addition, there is a docking direction defined by the card edge connector coupling to the circuit board, and the circuit transferring board is parallel to the docking direction. In the embodiment, the slot of the second insulator has a positioning portion whereby the circuit transferring board can be fixed in the slot after inserting.

In one preferred embodiment, the first terminals are located above the second terminals, and the first terminals and the second terminals are interleaved.

In one preferred embodiment, the back end face of the second insulator has a long-slotted hole, and the flexible flat cable can pass through the long-slotted hole and drawn out from a bottom surface of the second insulator. Accordingly, the flexible flat cable is bent to form a plurality of bending portions.

To achieve the other objective mentioned above, the card edge connector assembly provided by an embodiment of the present invention includes a first insulator, a second insulator, a plurality of first terminals, a plurality of second terminals, a circuit transferring board, a flexible flat cable, and a circuit board. The first insulator has a plug space, a plurality of first terminal holes located above the plug space, and a plurality of second terminal holes located below the plug space. The second insulator has a front end face and a back end face, and the front end face abuts against the first insulator and has a plurality of first slotted holes interconnecting with the first terminal holes and a plurality of second slotted holes interconnecting with the second terminal holes. The back end face has a slot. The first terminals are disposed within the first terminal holes and the first slotted holes. The second terminals are disposed within the second terminal holes and the second slotted holes, wherein the first terminals and the second terminals comprise a plurality of front contact portions and a plurality of back contact portions. The front contact portions reach the plug space via the first terminal holes and the second terminal holes, and the back contact portions reach the slot via the first slotted holes and the second slotted holes. The circuit transferring board is inserted into the slot of the second insulator. The circuit transferring board comprises a plurality of first conductive portions, second conductive portions, and welding portions, wherein the back contact portions are electrically coupled to the first conductive portions and the second conductive portions. The flexible flat cable comprises a plurality of conductors which are welded to the welding portions of the circuit transferring board. The circuit board has a card edge portion, and the card edge portion has an upper side and a lower side with a plurality of conductive portions. The card edge portion is inserted into the plug space of the first insulator. The front contact portions of the first terminals electrically contact the conductive portions located on the upper side of the card edge portion, and the front contact portions of the second terminals electrically contact the conductive portions located on the lower side of the card edge portion.

In one preferred embodiment, the first insulator has a fool-proofing structure, so that the card edge portion can be inserted into the plug space in only one direction. Specifically, the fool-proofing structure is a groove disposed upon a side of the first insulator.

In comparison with the prior art, the back contact portions of the first and second terminals employed by the present invention are capable of resiliently contacting the circuit transferring board, vertically, so there is no need to connect them by using welding, thereby solving the problems of the conventional welded connection. Moreover, convenience of repair is increased because of the resilient contact.

It is to be understood that both the foregoing general description and the following detailed description of the present invention are exemplary and explanatory and are intended to provide further explanation of the invention as claimed.

DETAILED DESCRIPTION OF THE INVENTION

Figure 1:
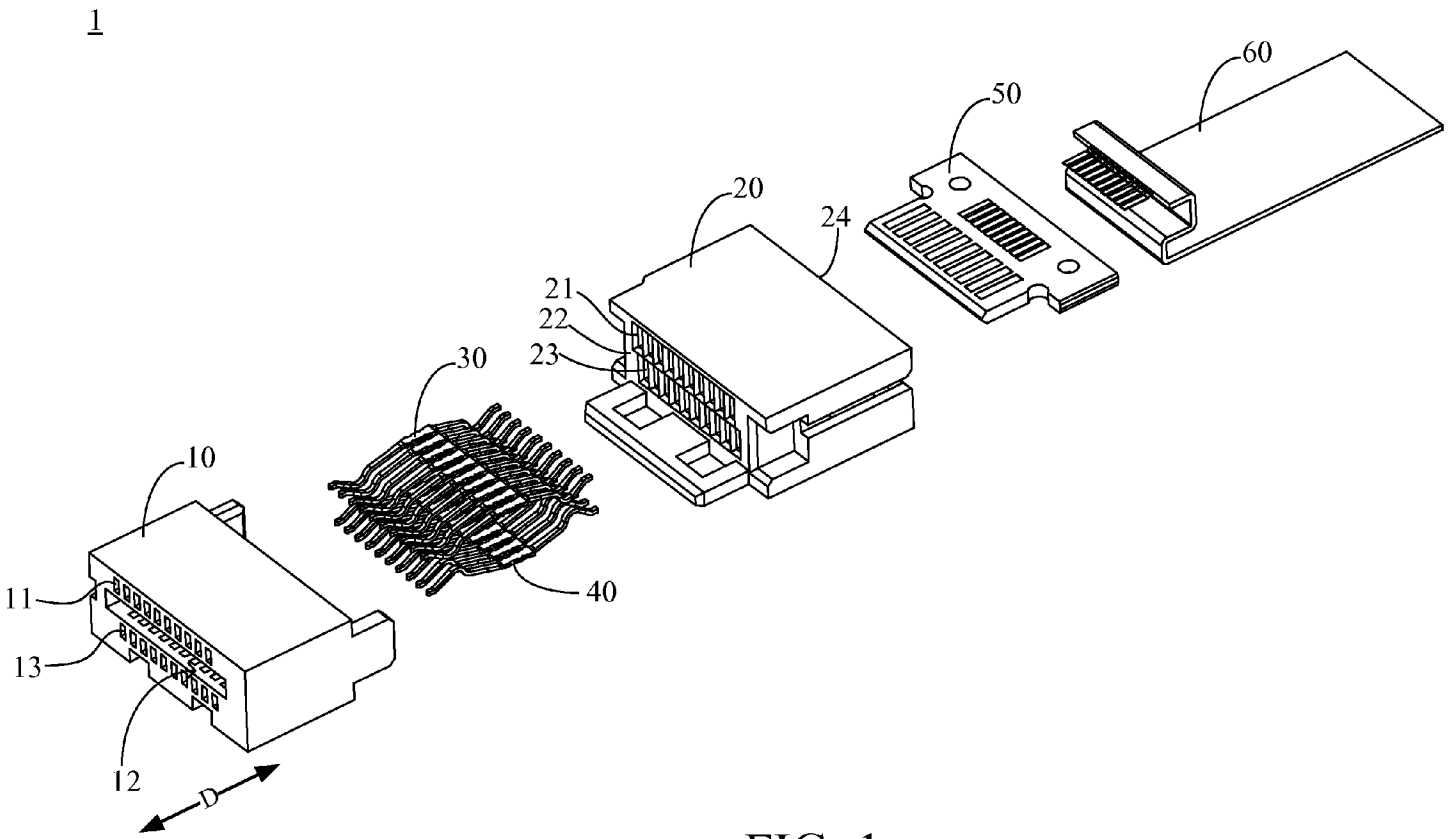
FIG. 1 depicts an exploded view of a card edge connector according to a preferred embodiment of the present invention.

Descriptions of the following embodiments refer to attached drawings which are utilized to exemplify specific embodiments. Directional terms mentioned in the present invention, such as "top" and "down", "front", "rear", "left", "right", "inside", "outside", "side" and so on are only directions with respect to the attached drawings. Therefore, the used directional terms are utilized to explain and understand the present invention but not to limit the present invention. In different drawings, the same reference numerals refer to like parts throughout the drawings.

Refer to FIG. 1, which depicts an exploded view of a card edge connector according to a preferred embodiment of the present invention. The card edge connector 1 of the embodiment is utilized to couple to a circuit board (not shown). The card edge connector 1 includes a first insulator 10, a second insulator 20, a plurality of first terminals 30, a plurality of second terminals 40, a circuit transferring board 50, and a flexible flat cable (FFC) 60.

As shown in the drawing, the first insulator 10 has a plug space 12 or coupling to the circuit board. The first insulator 10 has a plurality of first terminal holes 11 located above the plug space 12, and a plurality of second terminal holes 13 located below the plug space 12.

Figure 2:
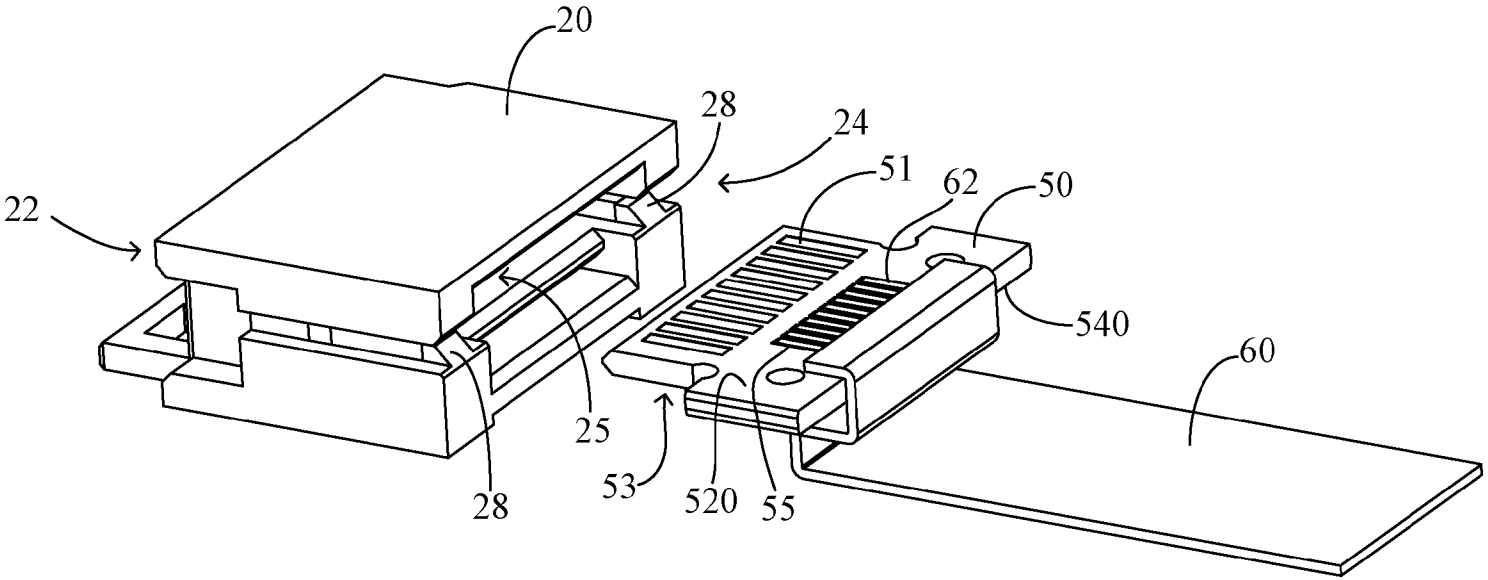
FIG. 2 is an exploded view of some parts of the elements in the embodiment.
Figure 3:
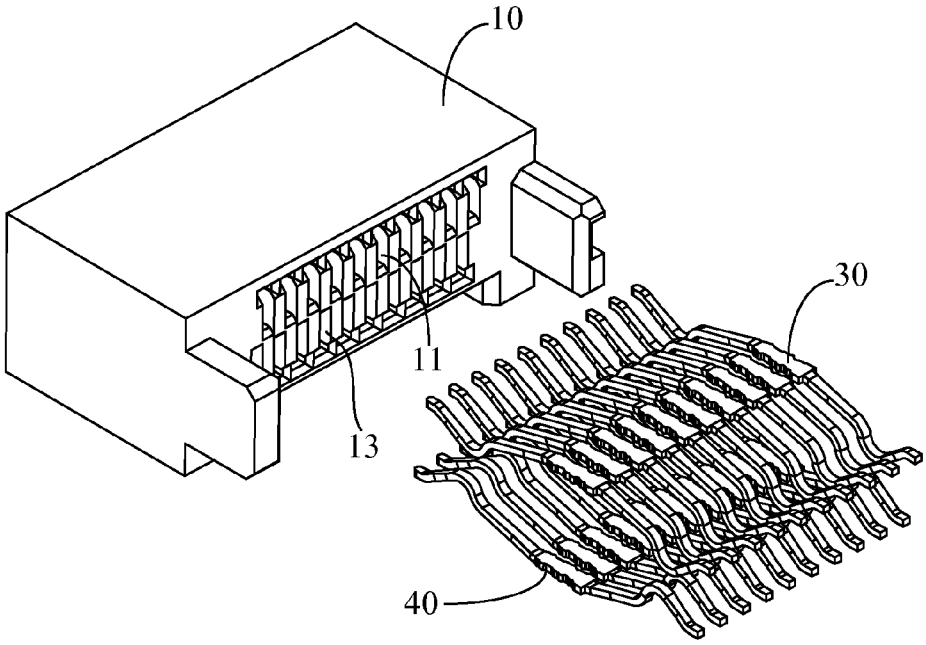
FIG. 3 is an exploded view of the first insulator and a plurality of first and second terminals in the embodiment.
Figure 4:
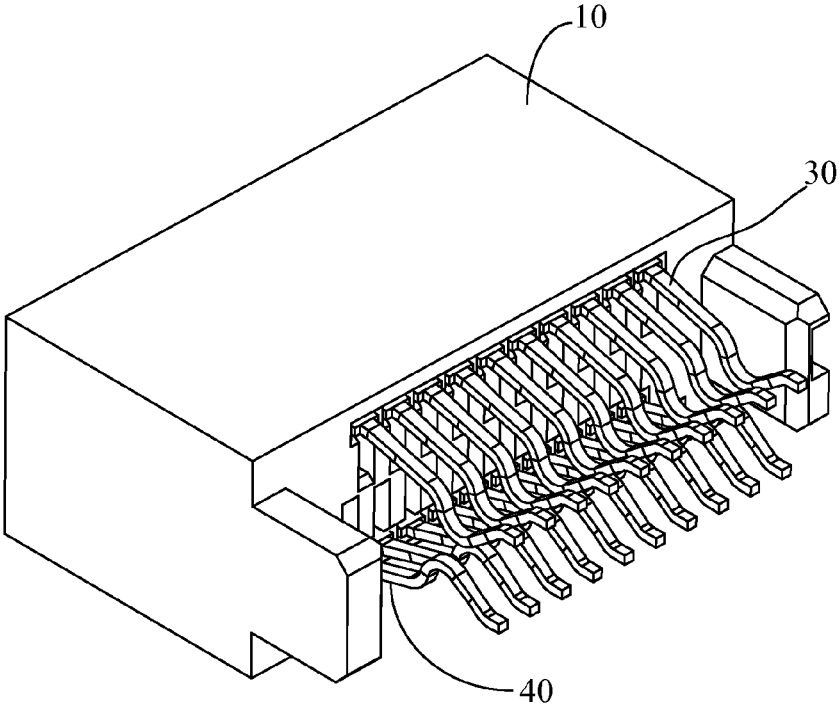
FIG. 4 is a perspective view illustrating an assembly of these in FIG. 3.
Figure 5:
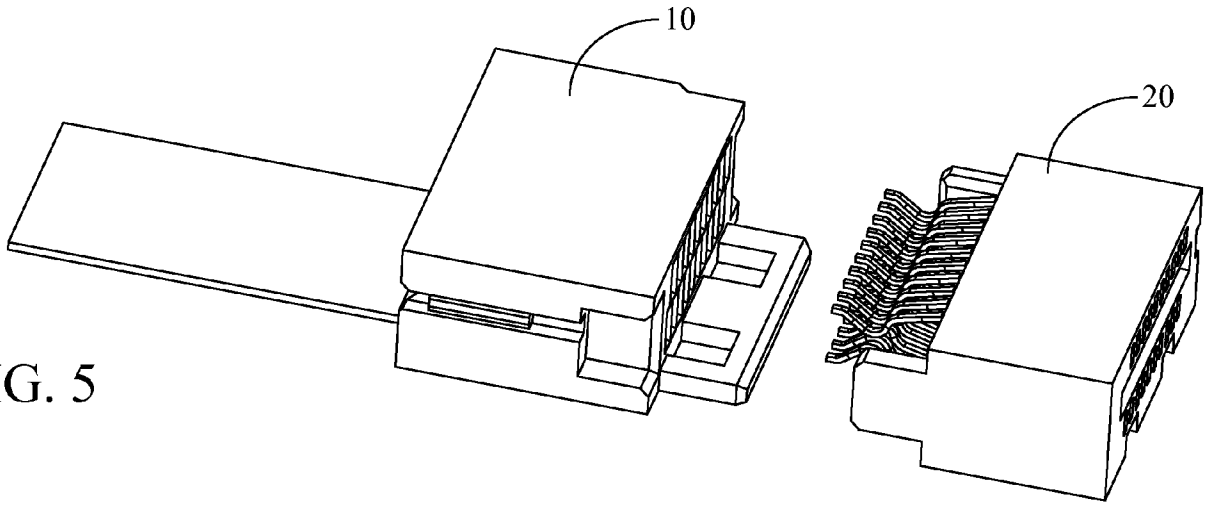
FIG. 5 and FIG. 6 are schematic drawings illustrating the assembly of the first insulator and the second insulator.
Figure 6:
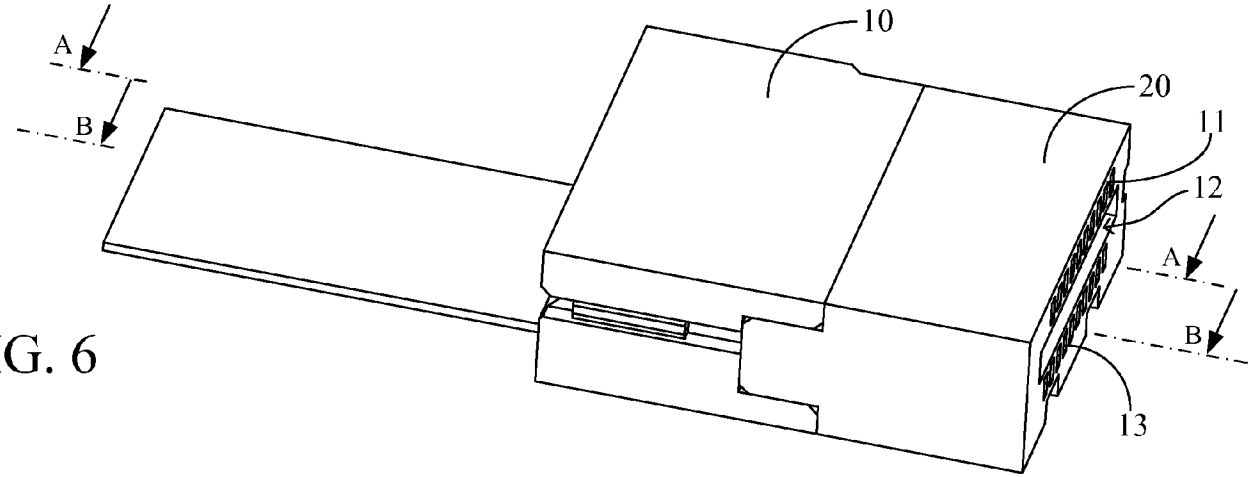

Referring to FIGS. 1 to 4, FIG. 2 is an exploded view of some parts of the elements in the embodiment; FIG. 3 is an exploded view of the first insulator and a plurality of first and second terminals in the embodiment; and FIG. 4 is a perspective view illustrating an assembly of these in FIG. 3. The second insulator 20 has a front end face 22 and a back end face 24, and the front end face 22 abuts against the first insulator 10. The front end face 22 has a plurality of first slotted holes 21 interconnecting with the first terminal holes 11 and a plurality of second slotted holes 23 interconnecting with the second terminal holes 13. Moreover, the back end face 24 of the second insulator 20 has a slot 25. The first terminals 30 are disposed within the first terminal holes 11 and the first slotted holes 21. Similarly, the second terminals 40 are disposed within the second terminal holes 13 and the second slotted holes 23. In the embodiment, the first terminals 30 are located above the second terminals 40, and the first terminals 30 and the second terminals 40 are interleaved.

Figure 7:
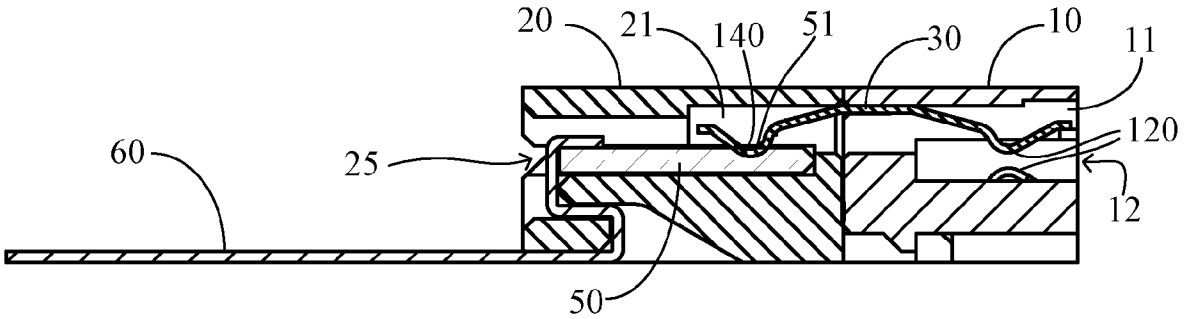
FIG. 7 is a cross-sectional view along A-A in FIG. 6.
Figure 8:
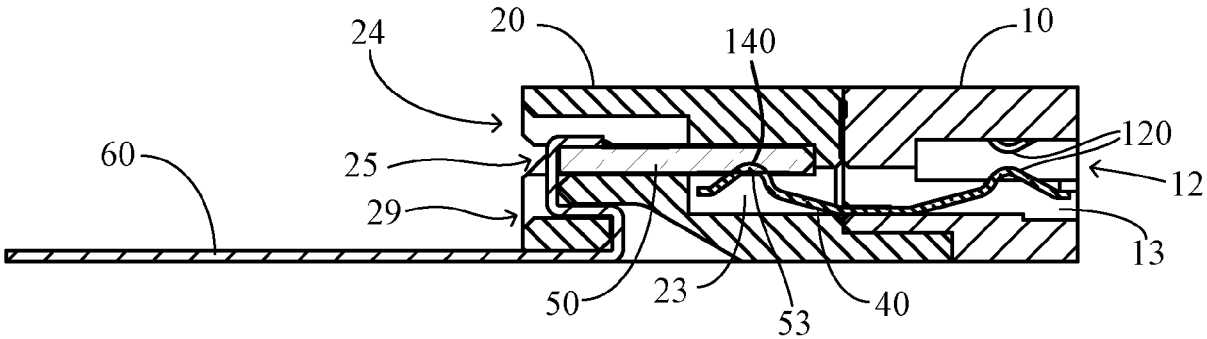
FIG. 8 is a cross-sectional view along B-B in FIG. 6.

Referring to FIGS. 5 to 8, FIG. 5 and FIG. 6 are schematic drawings illustrating the assembly of the first insulator and the second insulator; FIG. 7 is a cross-sectional view along A-A in FIG. 6; and FIG. 8 is a cross-sectional view along B-B in FIG. 6. The first terminals 30 and the second terminals 40 comprise a plurality of front contact portions 120 and a plurality of back contact portions 140. The front contact portions 120 reach the plug space 12 via the first terminal holes 11 and the second terminal holes 13, and the back contact portions 140 reach the slot 25 via the first slotted holes 21 and the second slotted holes 23.

As shown in FIGS. 2 and 7-8, the circuit transferring board 50 is inserted into the slot 25 of the second insulator 20. The circuit transferring board 50 comprises a plurality of first conductive portions 51, second conductive portions 53, and welding portions 55. The back contact portions 140 of the first terminals 30 and the second terminals 40 are electrically coupled to the first conductive portions 51 and the second conductive portions 53. Specifically, the first conductive portions 51 are disposed on an upper surface 520 of the circuit transferring board 50, and the second conductive portions 53 are disposed on a lower surface 540 of the circuit transferring board 50. Accordingly, the back contact portions 140 of the first terminals 30 electrically contact the first conductive portions, and the back contact portions of the second terminals electrically contact the second conductive portions.

On the other hand, the flexible flat cable 60 includes a plurality of conductors 62 which are welded to the welding portions 55 of the circuit transferring board 50. It is worth mentioning that the conductors 62 and welding portions 55 may be covered with an insulating adhesive (not shown) in order to ensure the connection of the two is solid. In the embodiment, the welding portions 55 are disposed on a surface of the circuit transferring board 50, and the first conductive portions 51 and the second conductive portions 53 are electrically coupled to the welding portions 55. That is to say, all the first conductive portion 51 and second conductive portion 53 of the upper and lower surfaces are coupled to the welding portions 55 via traces within the circuit transferring board 50. In the embodiment, the spacing of the welding portions 55 is less than or equal to that of the first conductive portions 51 and the second conductive portions 53.

Referring to FIG. 1 and FIG. 2 again, there is a docking direction D defined by the card edge connector 1 coupling to the circuit board, and the circuit transferring board 50 is parallel to the docking direction D. It is worth mentioning that the slot 25 of the second insulator 20 has a positioning portion 28 such that the circuit transferring board 50 can be fixed in the slot 25 after inserting. However, when that needs repair, the circuit transferring board 50 can be pulled out by pushing the slot 25 outward without a de-soldering process.

Figure 9:
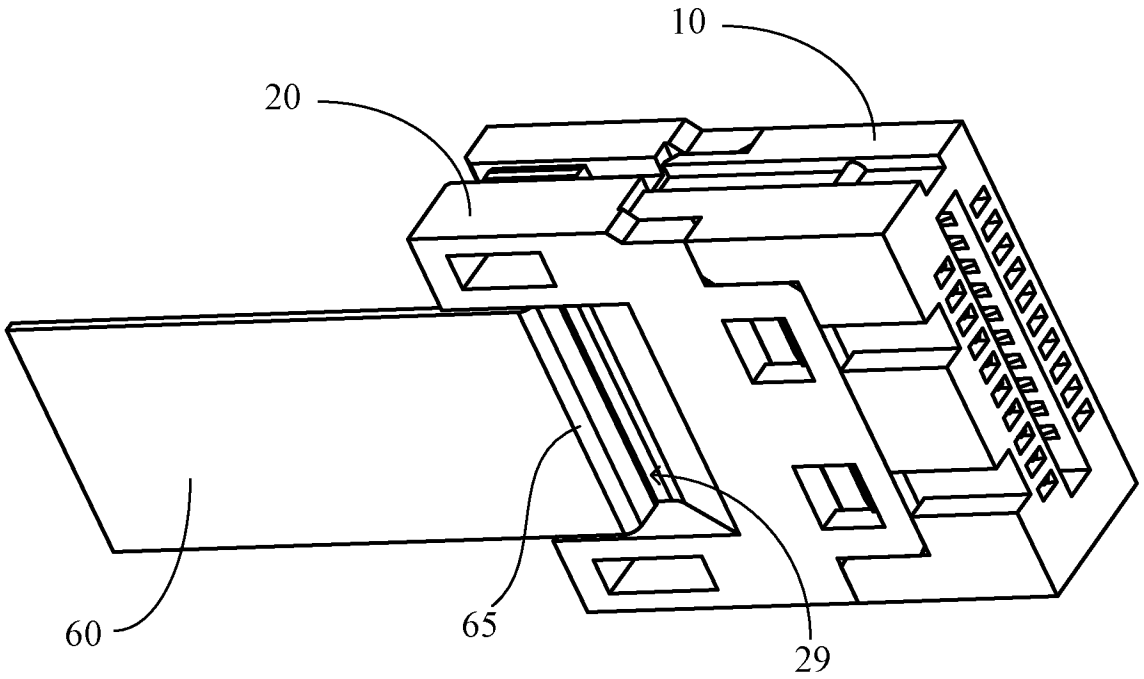
FIG. 9 is a perspective view illustrating the bottom of the card edge connector according to the embodiment.

Referring to FIG. 8 and FIG. 9, FIG. 9 is a perspective view illustrating the bottom of the card edge connector according to the embodiment. The back end face 24 of the second insulator 20 has a long-slotted hole 29, and the flexible flat cable 60 can pass through the long-slotted hole 29 and drawn out from a bottom surface of the second insulator 20. Specifically, the flexible flat cable 60 is bent to form a plurality of bending portions 65, so as to improve firmness of the connection.

What follows is a detail of a card edge connector assembly adopting the card edge connector 1 of the above-mentioned embodiment. Referring to FIGS. 1 to 10, FIG. 10 is a partial exploded view of a card edge connector assembly according to a preferred embodiment of the present invention. The card edge connector assembly includes a first insulator 10, a second insulator 20, a plurality of first terminals 30, a plurality of second terminals 40, a circuit transferring board 50, a flexible flat cable 60, and a circuit board 70.

The first insulator 10 has a plug space 12. The first insulator 10 has a plurality of first terminal holes 11 located above the plug space 12, and a plurality of second terminal holes 13 located below the plug space 12. The second insulator 20 has a front end face 22 and a back end face 24, and the front end face 22 abuts against the first insulator 10. The front end face 22 has a plurality of first slotted holes 21 interconnecting with the first terminal holes 11 and a plurality of second slotted holes 23 interconnecting with the second terminal holes 13. The back end face 24 has a slot 25. The first terminals 30 are disposed within the first terminal holes 11 and the first slotted holes 21. The second terminals 40 are disposed within the second terminal holes 13 and the second slotted holes 23, wherein the first terminals 30 and the second terminals 40 comprise a plurality of front contact portions 120 and a plurality of back contact portions 142. The front contact portions 120 reach the plug space 12 via the first terminal holes 11 and the second terminal holes 13, and the back contact portions 140 reach the slot 25 via the first slotted holes 21 and the second slotted holes 23. The circuit transferring board 50 is inserted into the slot 25 of the second insulator 20. The circuit transferring board 50 comprises a plurality of first conductive portions 51, second conductive portions 53, and welding portions 55, wherein the back contact portions 140 are electrically coupled to the first conductive portions 51 and the second conductive portions 53. The flexible flat cable 60 includes a plurality of conductors 62 which are welded to the welding portions 55. The descriptions of the same elements have been explained as above mention, so no further detail will be provided herein.

Figure 10:
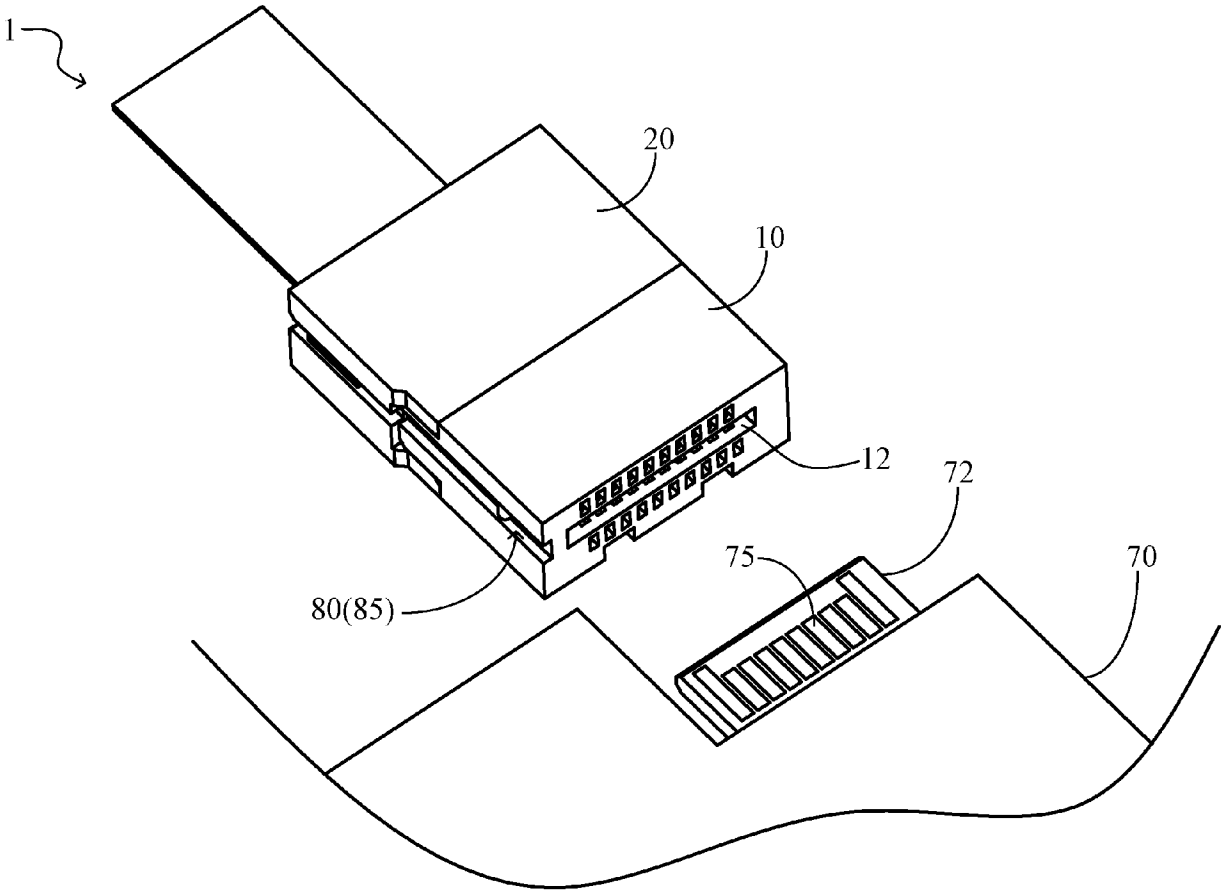
FIG. 10 is a partial exploded view of a card edge connector assembly according to a preferred embodiment of the present invention.

As shown in FIG. 10, the circuit board 70 has a card edge portion 72, and the card edge portion 72 has an upper side and a lower side with a plurality of conductive portions 75. The card edge portion 72 is inserted into the plug space 12 of the first insulator 10. The front contact portions 120 of the first terminals 30 electrically contact the conductive portions 75 located on the upper side of the card edge portion 72, and the front contact portions 120 of the second terminals 40 electrically contact the conductive portions 75 located on the lower side of the card edge portion 72.

Notably, the first insulator 10 has a fool-proofing structure 80, so that the card edge portion 72 can be inserted into the plug space 12 in only one direction. Specifically, the fool-proofing structure 82 is a groove 85 disposed upon a side of the first insulator 10. However, the specific structures of the fool-proofing structure 80 are not limited in the present invention, and other fool-proofing structures are also within the scope of the present invention.

In summary, the back contact portions 140 of the first terminals 30 and second terminals 40 employed by the present invention are capable of resiliently contacting the circuit transferring board 50, vertically, so there is no need to connect them by using the welding, thereby solving the problems resulting from adopting the conventional welding. Moreover, the convenience of repair is increased due to the resilient contact.

While the preferred embodiments of the present invention have been illustrated and described in detail, various modifications and alterations can be made by persons skilled in this art. The embodiment of the present invention, is therefore described in an illustrative but not restrictive sense.

What is claimed is:

1. A card edge connector for coupling to a circuit board, the card edge connector comprising:

a first insulator having a plug space for coupling to the circuit board, the first insulator having a plurality of first terminal holes located above the plug space and a plurality of second terminal holes located below the plug space;

a second insulator having a front end face and a back end face, the front end face abutting against the first insulator and having a plurality of first slotted holes interconnecting with the first terminal holes and a plurality of second slotted holes interconnecting with the second terminal holes, and the back end face having a slot;

a plurality of first terminals disposed within the first terminal holes and the first slotted holes;

a plurality of second terminals disposed within the second terminal holes and the second slotted holes, wherein the first terminals and the second terminals comprise a plurality of front contact portions and a plurality of back contact portions, the front contact portions reach to the plug space via the first terminal holes and the second terminal holes, and the back contact portions reach to the slot via the first slotted holes and the second slotted holes;

a circuit transferring board being inserted into the slot of the second insulator, the circuit transferring board comprising a plurality of first conductive portions, second conductive portions, and welding portions, wherein the back contact portions are electrically coupled to the first conductive portions and the second conductive portions; and a flexible flat cable comprising a plurality of conductors which are welded to the welding portions of the circuit transferring board.

2. The card edge connector of claim 1, wherein the first conductive portions are disposed on an upper surface of the circuit transferring board, the second conductive portions are disposed on a lower surface of the circuit transferring board, the back contact portions of the first terminals electrically contact the first conductive portions, and the back contact portions of the second terminals electrically contact the second conductive portions.

3. The card edge connector of claim 2, wherein the welding portions are disposed on a surface of the circuit transferring board, and the first conductive portions and the second conductive portions are electrically coupled to the welding portions.

4. The card edge connector of claim 3, wherein there is a docking direction defined by the card edge connector coupling to the circuit board, and the circuit transferring board is parallel to the docking direction.

5. The card edge connector of claim 4, wherein the slot of the second insulator has a positioning portion whereby the circuit transferring board can be fixed in the slot after inserting.

6. The card edge connector of claim 1, wherein the first terminals are located above the second terminals; and the first terminals and the second terminals are interleaved.

7. The card edge connector of claim 1, wherein the back end face of the second insulator has a long-slotted hole, and the flexible flat cable can pass through the long-slotted hole and drawn out from a bottom surface of the second insulator.

8. The card edge connector of claim 7, wherein the flexible flat cable is bent to form a plurality of bending portions.

9. A card edge connector assembly, comprising:

a first insulator having a plug space, a plurality of first terminal holes located above the plug space, and a plurality of second terminal holes located below the plug space;

a second insulator having a front end face and a back end face, the front end face abutting against the first insulator and having a plurality of first slotted holes interconnecting with the first terminal holes and a plurality of second slotted holes interconnecting with the second terminal holes, and the back end face having a slot;

a plurality of first terminals disposed within the first terminal holes and the first slotted holes;

a plurality of second terminals disposed within the second terminal holes and the second slotted holes, wherein the first terminals and the second terminals comprise a plurality of front contact portions and a plurality of back contact portions, the front contact portions reach to the plug space via the first terminal holes and the second terminal holes, and the back contact portions reach to the slot via the first slotted holes and the second slotted holes;

a circuit transferring board being inserted into the slot of the second insulator, the circuit transferring board comprising a plurality of first conductive portions, second conductive portions, and welding portions, wherein the back contact portions are electrically coupled to the first conductive portions and the second conductive portions;

a flexible flat cable comprising a plurality of conductors which are welded to the welding portions of the circuit transferring board; and a circuit board having a card edge portion, the card edge portion having a upper side and a lower side with a plurality of conductive portions, the card edge portion being inserted into the plug space of the first insulator, the front contact portions of the first terminals electrically contacting the conductive portions located on the upper side of the card edge portion, and the front contact portions of the second terminals electrically contacting the conductive portions located on the lower side of the card edge portion.

10. The card edge connector assembly of claim 9, wherein the first conductive portions are disposed on an upper surface of the circuit transferring board, the second conductive portions are disposed on a lower surface of the circuit transferring board, the back contact portions of the first terminals electrically contact the first conductive portions, and the back contact portions of the second terminals electrically contact the second conductive portions.

11. The card edge connector assembly of claim 10, wherein the welding portions are disposed on a surface of the circuit transferring board, and the first conductive portions and the second conductive portions are electrically coupled to the welding portions.

12. The card edge connector assembly of claim 11, wherein there is a docking direction defined by the card edge connector coupling to the circuit board, and the circuit transferring board is parallel to the docking direction.

13. The card edge connector assembly of claim 12, wherein the slot of the second insulator has a positioning portion whereby the circuit transferring board can be fixed in the slot after inserting.

14. The card edge connector assembly of claim 9, wherein the first terminals are located above the second terminals, and the first terminals and the second terminals are interleaved.

15. The card edge connector assembly of claim 9, wherein the back end face of the second insulator has a long-slotted hole, and the flexible flat cable can pass through the long-slotted hole and drawn out from a bottom surface of the second insulator.

16. The card edge connector assembly of claim 15, wherein the flexible flat cable is bent to form a plurality of bending portions.

17. The card edge connector assembly of claim 9, wherein the first insulator has a fool-proofing structure, so that the card edge portion can be inserted into the plug space only in one direction.

18. The card edge connector assembly of claim 17, wherein the fool-proofing structure is a groove disposed upon a side of the first insulator.

* * * * *